United States Patent [19]

Noro

[11] Patent Number: 4,969,195

[45] Date of Patent: Nov. 6, 1990

[54] IMPEDANCE COMPENSATION CIRCUIT IN A SPEAKER DRIVING SYSTEM

[75] Inventor: Masao Noro, Hamamatsu, Japan

[73] Assignee: Yamaha Corporation, Hamamatsu, Japan

[21] Appl. No.: 345,345

[22] Filed: Apr. 28, 1989

[30] Foreign Application Priority Data

May 6, 1988 [JP] Japan ..... 63-110943

[51] Int. Cl.[5] ..... H04R 3/00

[52] U.S. Cl. ..... 381/96; 381/59

[58] Field of Search ..... 381/96, 59

[56] References Cited

U.S. PATENT DOCUMENTS 3,647,969 3/1972 Korn ..... 381/96

3,889,060 6/1975 Goto et al. ..... 381/96

4,797,933 1/1989 Hahne ..... 381/96

*Primary Examiner*—Forester W. Isen

*Attorney, Agent, or Firm*—Spensley Horn Jubas & Lubitz

[57] ABSTRACT

In an impedance compensation circuit of a speaker driving system, an ideal impedance state of the speaker can be equivalently formed by the equivalent impedance means, and is compared with an impedance state of an actual speaker. On the basis of the comparison result, a positive feedback gain in the speaker driving means is controlled. Therefore, even when the internal impedance of the speaker or the impedance of the connecting cable varies, or when the internal impedance of the speaker is changed upon a change in temperature, the motional impedance of the speaker can always be driven and damped with a constant driving impedance. For this reason, in the negative-impedance driving system, an ideal speaker control state can always be realized.

5 Claims, 8 Drawing Sheets

IMPEDANCE COMPENSATION CIRCUIT IN A SPEAKER DRIVING SYSTEM

BACKGROUND OF THE INVENTION:

1. Field of the Invention

The present invention relates to an impedance compensation circuit in a speaker driving system and, more particularly, to an impedance compensation circuit which can prevent a change in drive state caused by a variation in internal impedance inherent in a speaker, a variation in impedance of a connecting cable or the like for connecting the speaker and a driver, and changes in such impedances due to a change in temperature.

2. Description of the Prior Art

In general, an electromagnetic converter (dynamic electro-acoustic converter) such as a speaker obtains a driving force by flowing a current i through a coil (e.g., a copper wire coil) in a magnetic gap of a magnetic circuit. If a conductor length of the copper wire coil is represented by l and an intensity of a magnetic field of the magnetic gap is represented by B, a driving force F appearing at the copper wire coil is given by:

$$F = B \cdot l \cdot i$$

In constant-current driving, since an electromagnetic damping effect cannot satisfactorily function, a constant-voltage driving system is normally employed for driving a speaker system. In the constant-voltage driving system, the current i flowing through a voice coil changes depending on an internal impedance inherent in a speaker and an impedance of a connecting cable with a driver side. Therefore, the driving force F appearing at the copper wire coil varies or changes depending on a variation of the speaker or connecting cable or changes in impedances caused by a change in temperature.

The above-mentioned electromagnetic conversion system generally has a motional impedance. A resistance of the voice coil or the connecting cable also serves as a damping resistance of this motional impedance. For this reason, when the internal impedance of the speaker or the impedance of the connecting cable varies, the damping force to the voice coil also varies. When these impedances vary upon a change in temperature, this damping force is also changed.

A negative impedance driving system which can realize a larger driving force and damping force than the constant-current driving system has been proposed. In this system, a negative output impedance is equivalently generated in a driver, and a speaker as a load is negative-impedance driven. In order to equivalently generate the negative output impedance, a current flowing through the voice coil of the speaker as the load must be detected. For this purpose, a detection element is connected in series with the load. In the system performing the negative-impedance driving, an internal impedance of the load is apparently eliminated or canceled by the equivalently generated negative output impedance, thus achieving both the large driving force and damping force at the same time.

This system will be briefly described below with reference to FIGS. 2(*a*) and 2(*b*). In FIG. 2(*a*), $Z_M$ corresponds to a motional impedance of an electromagnetic converter (speaker), and $R_{VO}$ corresponds to an internal resistance $R_V$ of a voice coil as a load. As shown in FIG. 2(*b*), the internal resistance $R_V$ is eliminated by a negative resistance $-R_A$ equivalently formed at a driver side, and an apparent driving impedance $Z_A$ is given by:

$$Z_A = R_V - R_A$$

In this case, when $Z_A$ becomes negative, the operation of the circuit becomes unstable. Therefore, in general, $R_V \geqq R_A$.

However, in the negative-impedance driving system described above, it is difficult to keep constant the driving impedance for the motional impedance with respect to variations in internal impedance of the speaker or impedance of the connecting cable or a change in internal impedance caused by a change in temperature. More Specifically, in the circuit shown in FIGS. 2(*a*) and 2(*b*), if the equivalent negative resistance $-R_A$ is kept constant, a ratio of an influence caused by a variation in internal impedance of the speaker or impedance of the connecting cable or a change caused by a change in temperature becomes larger than that in the above-mentioned constant-voltage driving system.

There is no conventional means for positively preventing an adverse influence caused by a variation in load impedance or a change in temperature which is particularly conspicuous in the negative-impedance driving system.

SUMMARY OF THE INVENTION

It is therefore an object of the present invention to provide an impedance compensation circuit which can keep an ideal speaker control state in a negative-impedance driving system even when an internal impedance of a speaker or an impedance of a connecting cable varies or particularly when an internal impedance of a voice coil of a speaker is changed due to a change in temperature.

An impedance compensation circuit according to the present invention comprises: speaker driving means for detecting a signal corresponding to a driving current of a speaker, positively feeding back the signal to an input side, and driving the speaker with a predetermined negative output impedance equivalently generated, thereby eliminating or invalidating an internal impedance inherent in the speaker; equivalent impedance means for equivalently forming an ideal impedance state of the speaker when viewed from the speaker driving means; comparison means for comparing an output signal from the equivalent impedance means with the signal corresponding to the driving current of the speaker; and feedback gain control means for controlling a positive feedback gain of the speaker driving means on the basis of a comparison result of the comparison means.

According to the present invention, an ideal impedance state is equivalently formed by the equivalent impedance means, and is compared with an actual impedance state of the speaker. A positive feedback gain of the speaker driving means is controlled on the basis of the comparison result. Therefore, even when the internal impedance of the speaker or the impedance of a connecting cable varies, or when the internal impedance changes in response to a change in temperature, the motional impedance of the speaker can always by driven and damped by a constant driving impedance.

DETAILED DESCRIPTION OF THE PREFERRED EMBODIMENTS

Figure 1:
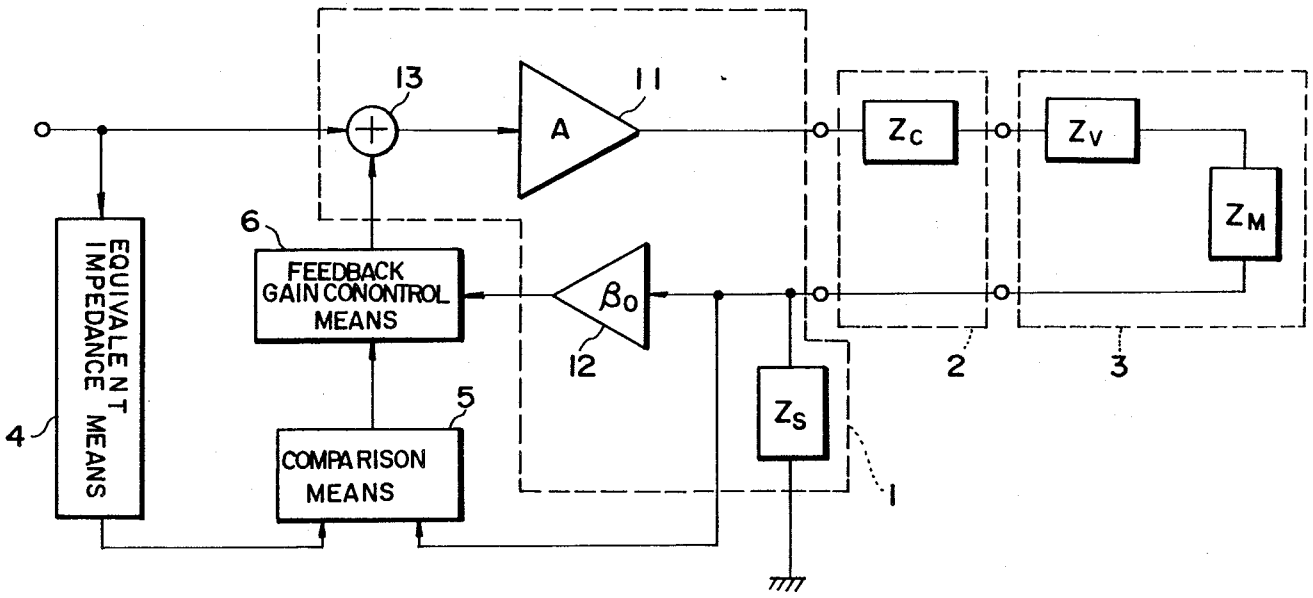
FIG. 1 is a block diagram showing a basic arrangement of an embodiment of the present invention.

An embodiment of the present invention will now be described with reference to FIGS. 1 to 9. In the following description, the same reference numerals denote the same parts throughout the drawings, and a repetitive description thereof will be omitted.

FIG. 1 is a block diagram showing a basic arrangement of an embodiment. As shown in FIG. 1, a speaker driving means 1 comprises an amplifier 11 of a gain A, a feedback circuit 12 of an inherent transmission gain $\beta_O$, an adder 13 for positively feeding back an output from the feedback circuit 12 to the amplifier 11, and a detection element $Z_S$. The output of the speaker driving means 1 is connected to a speaker 3 through a connecting cable 2 having an impedance $Z_C$. The speaker 3 has an inherent internal impedance $Z_V$ and motional impedance $Z_M$. An equivalent impedance means 4 equivalently forms an ideal impedance state of the speaker 3 when viewed from the speaker driving means 1, and has an equivalent impedance $Z_{ref}$. The output from the means 4 is supplied to a comparison means 5. The comparison means 5 compares the output signal from the equivalent impedance means 4 with a voltage detected by the detection element $Z_S$, and supplies a comparison result to a feedback gain control circuit 6. The feedback gain control circuit 6 controls a feed back gain of the feed back path to the amplifier 11 on the basis of the comparison result by the comparison means 5.

The reason why impedance compensation can be performed by the basic arrangement of this embodiment will be described below.

The main reason requiring impedance correction is a variation in internal impedance $Z_V$ of the speaker 3 and a variation in impedance $Z_C$ of the connecting cable 2. When the internal impedance $Z_V$ and the impedance $Z_C$ vary, the driving impedance for the motional impedance $Z_M$ of the speaker 3 also varies. The second reason is a change in internal impedance $Z_V$ of the speaker 3 due to a change in temperature. For example, when a driving current flows through the voice coil of the speaker 3, heat is generated according to the Joule law, and the internal impedance $Z_V$ is largely changed by the heat. Therefore, impedance compensation must be performed to keep an ideal impedance state even if these variations or changes occur. In the following description, for the sake of descriptive convenience, the sum of the internal impedance $Z_V$ of the speaker 3 and the impedance $Z_C$ of the connecting cable 2 is assumed to be an internal impedance $R_V$, and its design value is assumed to be $R_{VO}$. The detection element $Z_S$ is assumed to have a resistance $R_S$.

In order to compensate for a change or variation in impedance of a load, the present state of the impedance must be detected by any means. Data necessary for compensation can be an absolute value of the impedance of the load. However, compensation may be performed by a smaller data volume. More specifically, for the impedance of the load, a given value is assumed upon design (design value). Therefore, if it can be detected that an actual impedance of the load is larger or smaller than the design value, a feedback system for equivalently approximating the impedance of the load to the design value can be constituted.

Since an absolute value of the impedance of the load need not be detected, a signal whose nature is indefinite (having indefinite frequency or level) can be used as a measurement signal. Therefore, a music signal supplied to the speaker as a load can be used as the measurement signal. When no music signal is input, white noise generated by an amplifier itself is supplied to the speaker as the load although it is small. If a gain of a feedback loop is sufficiently increased, the white noise can be used as the measurement signal. The detection element $Z_S$ is arranged to detect the present state of the impedance of the load from such a measurement signal.

Figure 2A:
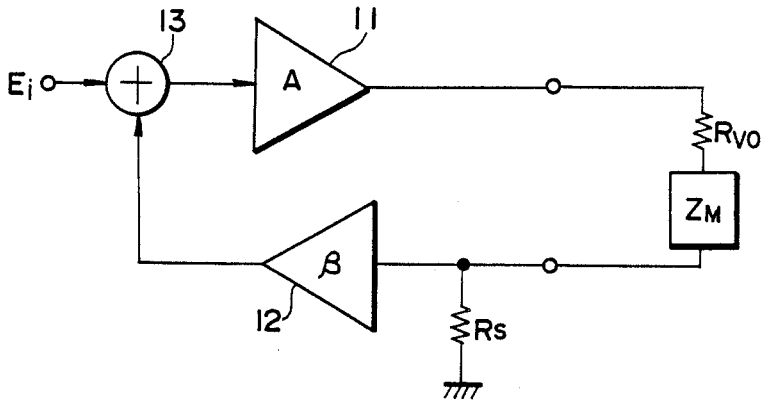
FIGS. 2(*a*) and 2(*b*) are respectively a block diagram and an equivalent circuit diagram of a circuit to be applied with the present invention.
Figure 2B:
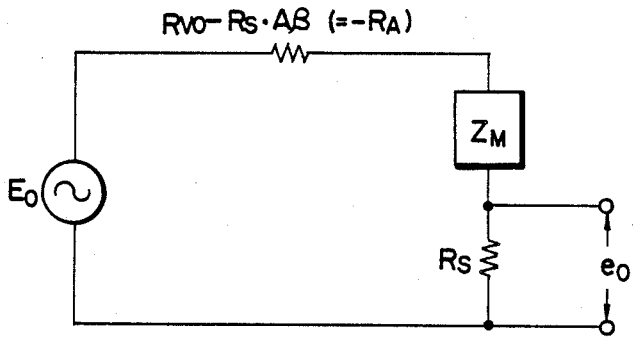

A circuit to be driven according to the present invention is as shown in FIG. 2(*a*), and its equivalent circuit is as shown in FIG. 2(*b*). In FIGS. 2(*a*) and 2(*b*), $R_{VO}$ is the design value, and is different from, the internal impedance $R_V$ of the actual load ($R_{VO} \neq R_V$). A driving impedance for the motional impedance $Z_M$ is given by:

$$R_{VO} - R_S A\beta + R_S = R_{VO} + R_S(1 - A\beta) \quad (1)$$

$E_i$ in FIG. 2(*a*) and $E_O$ in FIG. 2(*b*) have the relationship which is given by:

$$E_O = A\ E_i \quad (2)$$

In FIG. 2(*b*), the motional impedance $Z_M$ can be equivalently expressed by an electrical circuit. Therefore, as in the circuit shown in FIG. 2(*b*), a circuit having electrical transmission characteristics from $E_O$ to $e_O$ can be equivalently formed by combining electrical elements or using an operational amplifier and the like, as will be described later. When $R_V$ is the design value $R_{VO}$, if a circuit having transmission characteristics $F(S) = e_O/E_O$ is formed as shown in FIG. 3(*a*), $e_O$ and $e_S$ are compared in a circuit shown in FIG. 3(*b*), so that it can be detected whether or not the impedance of the actual load is offset from the design value.

Figure 3A:
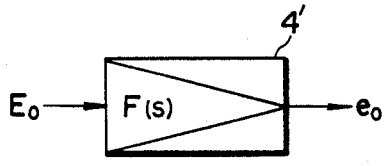
FIGS. 3(*a*) and 3(*b*) are circuit diagrams for explaining an equivalent impedance means.
Figure 3B:
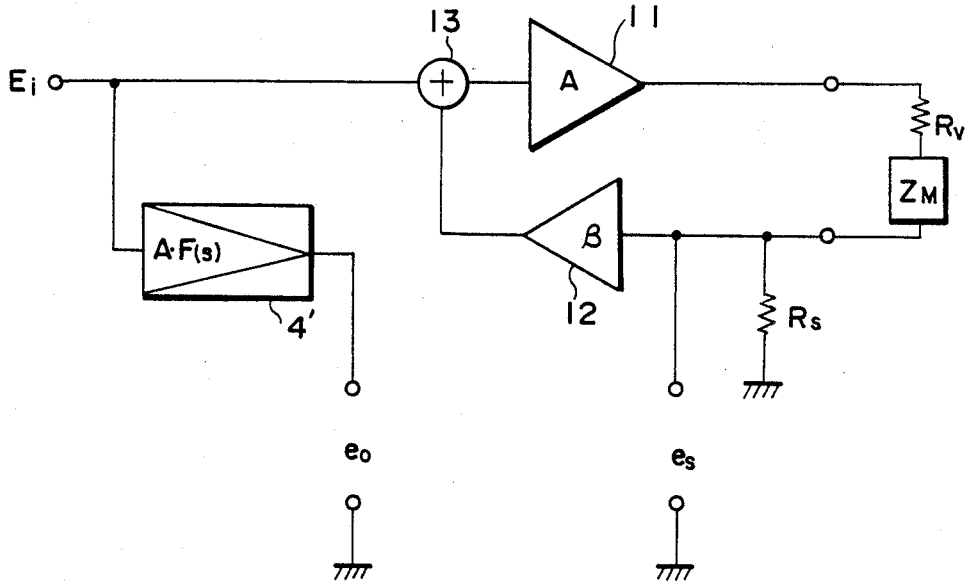

In FIG. 3(*b*), the transmission characteristics are given by $F(S) = e_O/E_O$, and $E_O = A\ E_i$ from equation (2). Therefore, the output from an equivalent circuit A F(S) is $e_O$. In this circuit, when $R_V = R_{VO}$, $e_O = e_S$; when $R_V > R_{VO}$, $e_O > e_S$; and when $R_V < R_{VO}$, $e_O < e_S$. Therefore, since $E_O = A\ E_i$ from equation (2) and $E_O$ is not influenced by the transmission gain $\beta$, $e_O$ can be compared with $e_S$ to adjust the transmission gain $\beta$. When a feedback system is constituted to satisfy $e_O = e_S$ in FIG. 3(*b*), a variation in internal impedance $R_V$ or the influence of a change caused by a change in temperature can be canceled.

Figure 4:
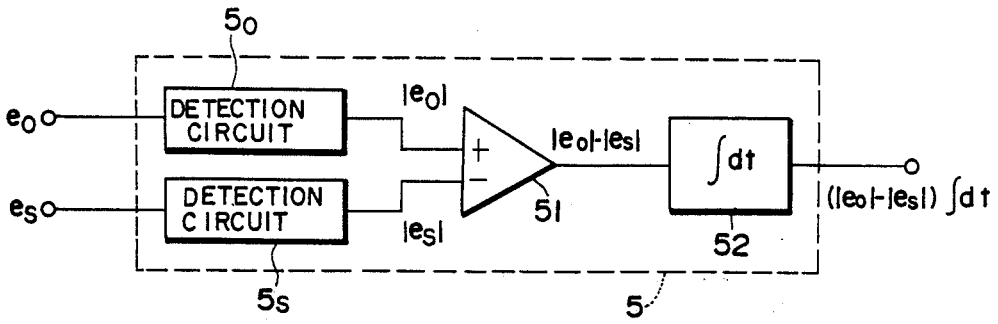
FIG. 4 is a circuit diagram of a comparison means.
Figure 5:
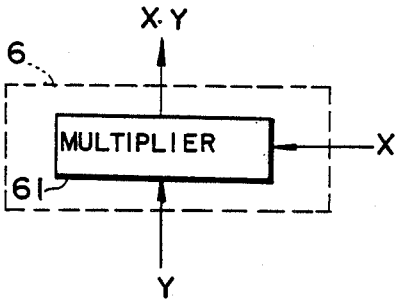
FIG. 5 is a circuit diagram of a feedback gain control means constituted by a multiplier.

Comparison between $e_O$ and $e_S$ can be performed by a circuit as shown in FIG. 4. In FIG. 4, detection circuits $5_O$ and $5_S$ output absolute values of $e_O$ and $e_S$, respectively, and their outputs $e_O$ and $e_S$ are from the comparator 51 is $(|e_O|-|e_S|)$. However, since this output includes many distortion waveforms with respect to original $e_O$ and $e_S$, if it is used in feedback control without any modification, an output waveform is distorted particularly when $R_V=R_{VO}$. Thus, an integrator 52 is connected to the output of the comparator 51 to remove the distortion component. The reason why the distortion component can be removed by time integration is that components which vary over time are those caused by a change in temperature (variation in $R_V$ does not vary over time), and the internal impedance $R_V$ is slowly increased upon a slow increase in temperature. If $(|e_O|-|e_S|)$ is integrated once and is fed back as almost a DC change, there is no problem in a practical use, and the integrator 52 can serve as a primary delay element of the feedback system to improve stability.

Finally, the comparison result is used for controlling a transmission gain of the feedback system. The feedback gain control means in this case can be constituted by a multiplier 61 shown in FIG. 5. Examining a polarity for feedback control, when $R_V>R_{VO}$, $e_O>e_S$. In this case, since too large $R_V$ must be compensated for, the driving impedance must be decreased. This invention aims at an improvement of an operation when $(1-A\beta)<0$. Since $A\beta>0$, the feedback gain $\beta$ is increased by the feedback gain control means 6 to decrease the driving impedance. Therefore, too large $R_V$ can be compensated for.

An embodiment of the present invention will now be described.

Figure 6:
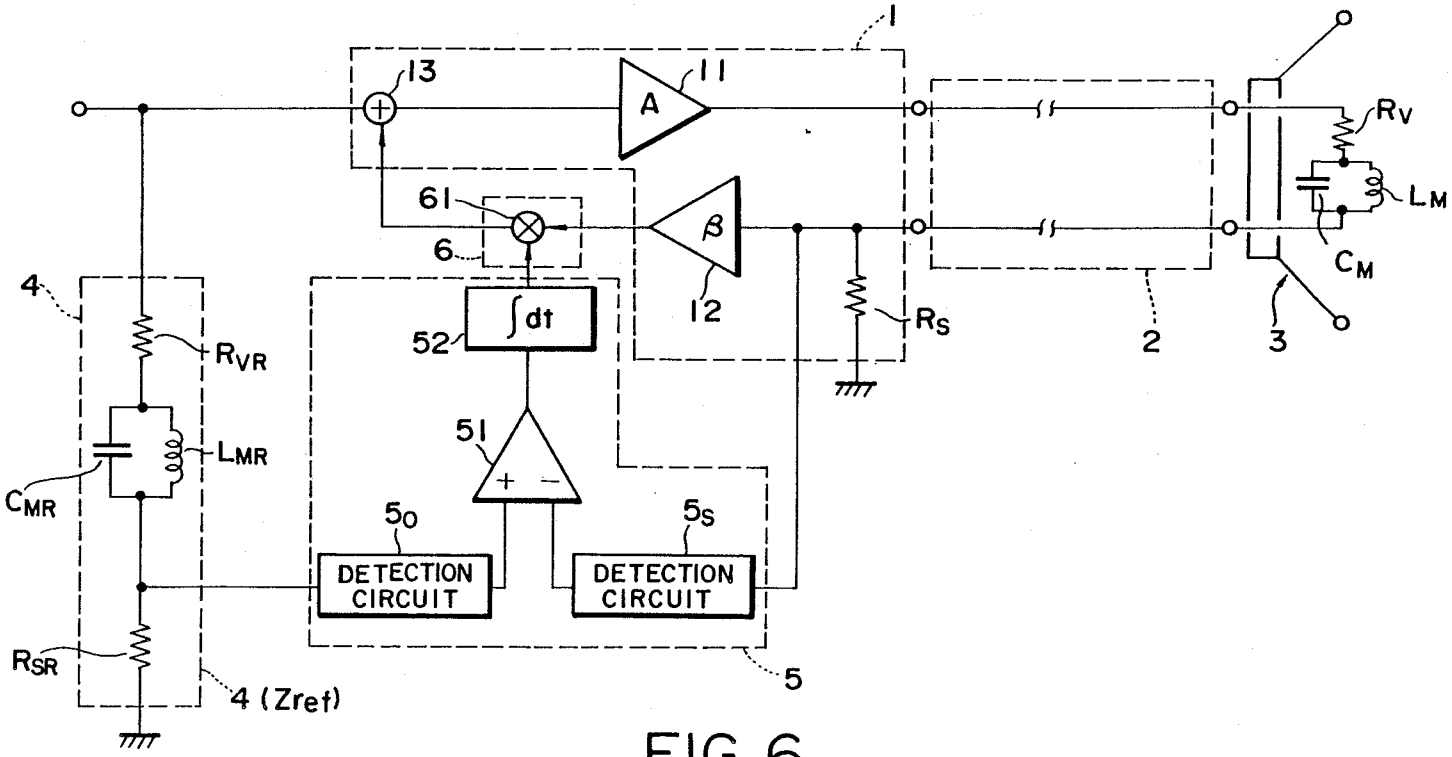
FIG. 6 is a circuit diagram of an embodiment of the present invention.

FIG. 6 is a circuit diagram of the embodiment. As shown in FIG. 6, the speaker 3 comprises a dynamic cone speaker, and its motional impedance $Z_M$ can be expressed by a parallel circuit of a capacitance component $C_M$ and an inductance component $L_M$. The equivalent impedance means 4 is constituted by a resistance $R_{VR}$ corresponding to the internal impedance $R_V$ of the speaker 3, a capacitance $C_{MR}$ and an inductance $L_{MR}$ respectively corresponding to the motional impedances $C_M$ and $L_M$, and a resistance $R_{SR}$ corresponding to the detection resistance $R_S$. Thus, an operation target value can be set. When the internal impedance $R_V$ of the speaker 3 is set to be 8Ω and −6Ω is equivalently generated to obtain an operation target value of 2Ω, if $R_S=0.1\Omega$ and the impedance $Z_C$ of the connecting cable 2 is ignored, $$R_{VR}:R_{SR}=19:1$$

For example, if $R_{VR}=1.9\Omega$, $R_{SR}=0.1\Omega$.

Figure 7A:
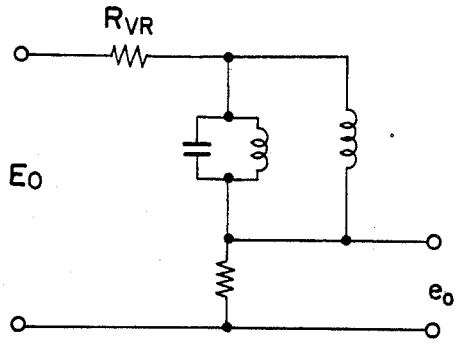
FIGS. 7(*a*) and 7(*b*) are circuit diagrams of the equivalent impedance means when a cabinet is taken into consideration.
Figure 7B:
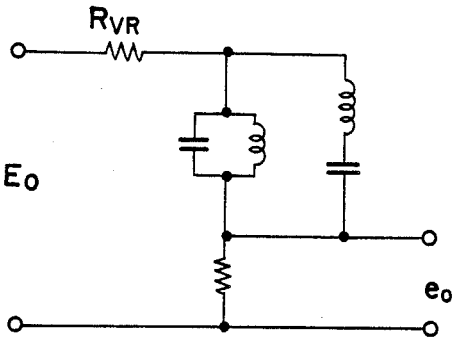

The detailed circuit arrangement of the equivalent impedance means 4 can be variously modified. For example, if a cabinet of the speaker is taken into consideration, the circuit is arranged as shown in FIG. 7(*a*) or 7(*b*). FIG. 7(*a*) shows a circuit when a speaker is attached to a closed cabinet, and FIG. 7(*b*) shows a circuit when a speaker is attached to a bass-reflex cabinet. As described above, the equivalent impedance means 4 may be formed by an operational amplifier or the like.

Figure 8:
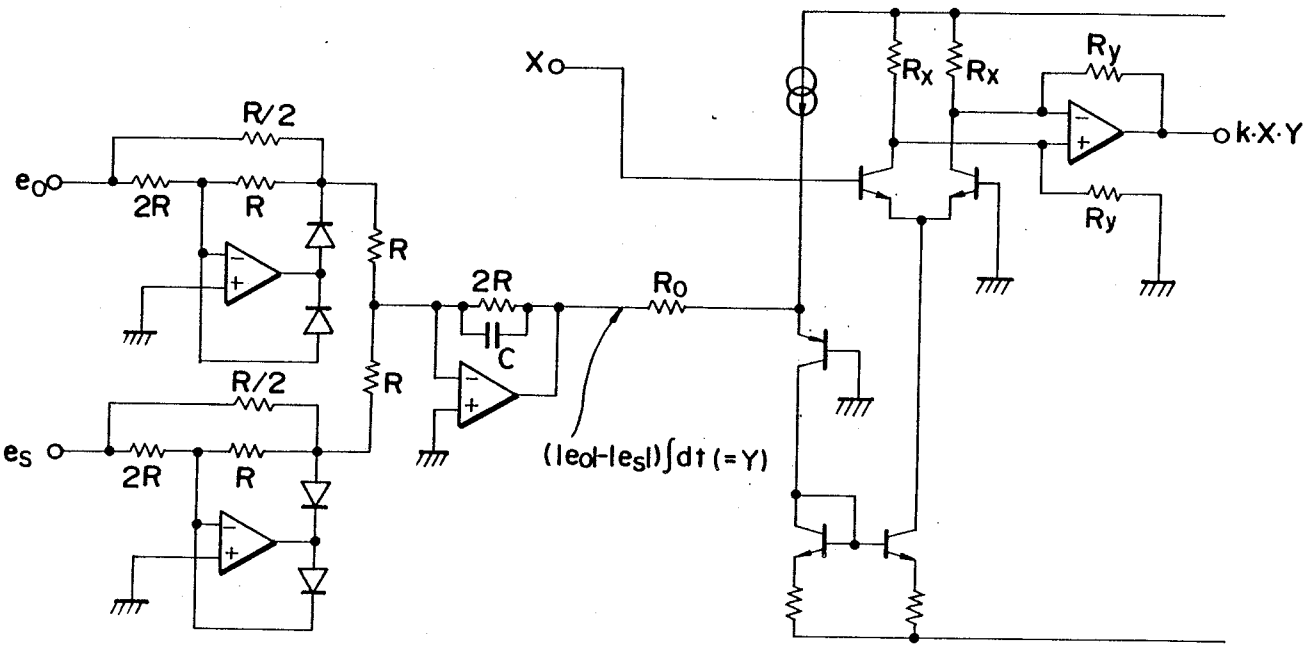
FIG. 8 is a circuit diagram of a practical comparison means.

As the comparison means 5 and the feedback gain control means 6, a circuit shown in FIG. 8 is practical. However, the present invention is not limited to this. For example, the multiplier 61 may be arranged as follows. In the circuit shown in FIG. 5, since a music signal passes along a path X→X·Y, good transmission performance at high frequencies is required. However, since almost a DC signal passes along a path Y→X·Y, a high speed response is not required. The feedback gain control means 6 can be constituted by thermo-coupling shown in FIGS. 9(*a*) and 9(*b*).

Figure 9A:
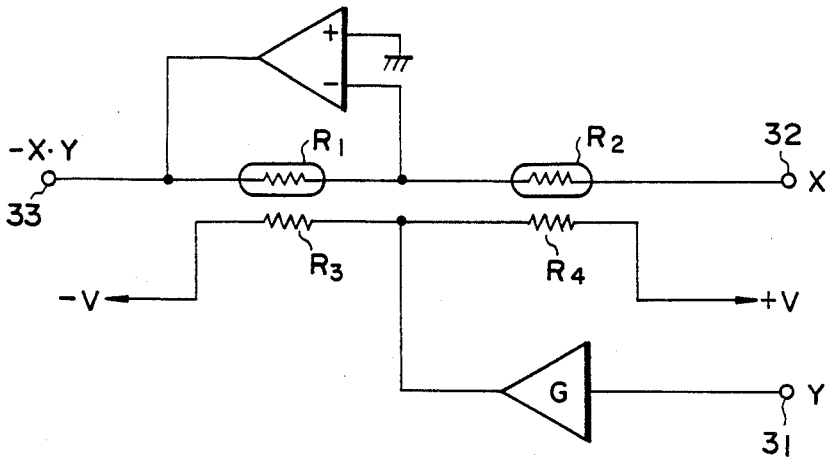
FIGS. 9(*a*) and 9(*b*) are circuit diagrams of other multipliers.
Figure 9B:
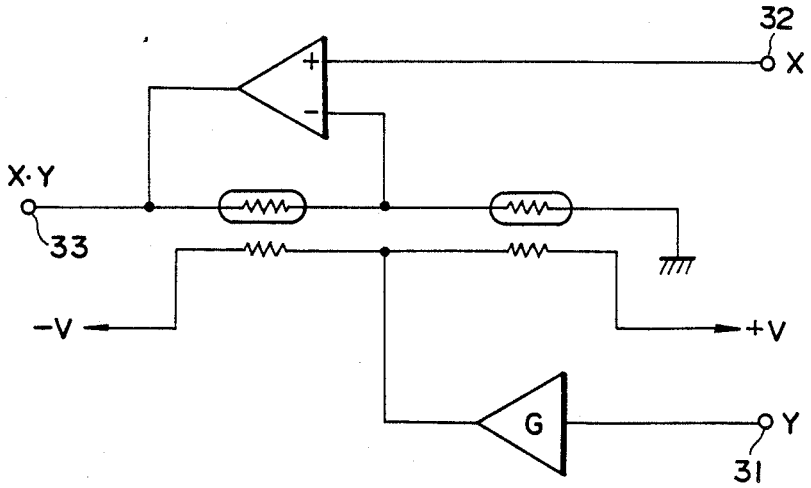

In FIG. 9(*a*), reference symbols $R_1$ and $R_2$ denote temperature-sensitive resistor elements whose resistances are changed depending on a temperature. These resistor elements are thermally coupled to heat-generation resistors $R_3$ and $R_4$. When a DC voltage signal Y from the comparison means 5 is applied to a terminal 31 in FIG. 9(*a*), a signal amplified by an amplifier G is applied to a node between the heat-generation resistor $R_3$ and $R_4$ to cause one of the resistors $R_3$ and $R_4$ to generate heat. As a result, the temperature of the other resistor is decreased. For this reason, the resistances of the heat-sensitive resistor elements $R_1$ and $R_2$ are changed, and a gain $-R_1/R_2$ from a terminal 32 to a terminal 33 is changed. A multiplication rate of a signal (feedback signal from the feedback circuit 12) X to the terminal 32 to a signal (feedback gain control signal from the comparison means 5) Y to the terminal 31 differs depending on the temperature coefficients and polarities of the used resistor elements $R_1$ and $R_2$. If the ratio is set by the amplifier G including the polarity, the output from the terminal 33 can be set to be −X·Y.

According to the circuit shown in FIG. 9(*a*), since the resistors $R_1$ to $R_4$ originally have thermal time constants, the integrator in the comparison means 5 can be omitted. A DC gain of the integrator can be obtained by adjusting the gain of the comparator or the amplifier G in FIG. 9(*a*). Note that FIG. 9(*a*) exemplifies an (X→−X·Y) amplifier whose output is inverted with respect to an input. A positive-phase amplifier can be arranged as shown in FIG. 9(*b*).

As described above, according to the present invention, an ideal impedance state of the speaker can be equivalently formed by the equivalent impedance means, and is compared with an impedance state of an actual speaker. On the basis of the comparison result, a positive feedback gain in the speaker driving means is controlled. Therefore, even when the internal impedance of the speaker or the impedance of the connecting cable varies, or when the internal impedance of the speaker is changed upon a change in temperature, the motional impedance of the speaker can always be driven and damped with a constant driving impedance. For this reason, in the negative-impedance driving system, an ideal speaker control state can always be realized.

What is claimed is:

1. An impedance compensation circuit comprising:

a speaker driving means for detecting a signal corresponding to a driving current of a speaker, feeding back the signal to an input side to provide positive feedback, and driving said speaker with a predetermined negative output impedance equivalently generated, thereby eliminating or invalidating an internal impedance inherent in said speaker;

an equivalent impedance means for equivalently forming an ideal impedance state of said speaker when viewed from said speaker driving means;

a comparison means for comparing an output signal from said equivalent impedance means with the signal corresponding to the driving current of said speaker; and a feedback gain control means for controlling a positive feedback gain of said speaker driving means on the basis of a comparison result of said comparison means.

2. A circuit according to claim 1, wherein said comparison means comprises a first detection circuit for detecting the magnitude of the output signal of said equivalent impedance means, a second detection circuit for detecting the magnitude of the signal corresponding to said driving current of the speaker, a comparator for detecting the difference between said two magnitudes, and an integrator for integrating the output signal of the comparator, the output signal of the integrator being fed as the comparison result to said feedback gain control means.

3. A circuit according to claim 1, wherein said feedback gain control means comprises a multiplier for outputting a signal corresponding to the product of said signal corresponding to the driving current of the speaker and said comparison result of the comparison means.

4. A circuit according to claim 1, wherein said feedback gain control means comprises an amplifier having a temperature-sesitive resistor element as a gain-determining resistor element, a heat-generation resistor element thermally coupled to the temperature-sesitive resistor element, the gain of the amplifier being controlled on the basis of the heat-generation level of the heat-generation resistor element.

5. An impedance compensation circuit comprising:

an amplifier for driving a speaker in response to an input signal, the amplifier including positive feedback means for detecting drive current of the speaker and providing a signal corresponding to the detected drive current as a feedback signal of the same polarity as the input signal to provide positive feedback and thereby drive the speaker with a negative output impedance to effectively reduce an internal impedance inherent in the speaker;

equivalent impedance means for receiving the input signal and providing an output signal corresponding to a desired impedance state of the speaker;

comparison means for comparing the output signal with a signal corresponding to the detected drive current; and positive feedback gain control means for controlling the gain of the positive feedback means in response to the comparison result of the comparison means so that the desired impedance state of the speaker is achieved.

* * * * *